United States Patent [19]

Dailey

[11] 4,401,134

[45] Aug. 30, 1983

[54] PILOT VALVE INITIATED MUD PULSE TELEMETRY SYSTEM

[75] Inventor: Patrick E. Dailey, Torrance, Calif.

[73] Assignee: Smith International, Inc., Newport Beach, Calif.

[21] Appl. No.: 240,875

[22] Filed: Mar. 5, 1981

[51] Int. Cl.[3] ..... F16K 31/124

[52] U.S. Cl. ..... 137/624.11; 251/29; 251/30; 251/57

[58] Field of Search ..... 251/29, 57, 30; 137/624.11, 624.13, 624.15, 488, 489, 492, 492.5

[56] References Cited

U.S. PATENT DOCUMENTS

| | | | |
|---|---|---|---|
| 2,728,547 | 12/1955 | Crookston | 251/57 X |
| 2,759,143 | 8/1956 | Arps . | |
| 2,898,088 | 8/1959 | Alder . | |
| 3,754,566 | 8/1973 | Gemigniani | 137/488 |
| 3,981,478 | 9/1976 | Lundsgart | 251/29 X |

*Primary Examiner*—Alan Cohan

*Attorney, Agent, or Firm*—Christie, Parker & Hale

[57] ABSTRACT

A mud pulser for mud flow in a conduit. A fluid reservoir operates when positioned in the flow of mud for imparting energy from the mud to separate fluid in the reservoir. A hydraulically operated valve is inserted in the flow of mud displaced from the fluid reservoir and includes an actuation chamber for the separate fluid. A fluid operated control valve is coupled between the fluid reservoir and the actuation chamber. An electrically controllable valve is coupled between the fluid reservoir and a control port for the control valve. The electrically controllable valve is operative in response to a first electrical signal applied thereto for providing communication in the separate fluid between the fluid reservoir and the control port to thereby allow an energy transfer in the fluid between the mud flow and the control port. The electrically controllable valve is also operative in response to a second electrical signal for blocking fluid communication between the fluid reservoir and the control port. The control valve is responsive to the energy transferred in the separate fluid to the control port for assuming a first condition wherein fluid communication between the fluid reservoir and the actuation chamber is blocked, and a second condition wherein fluid communication is provided through the control valve such that energy is transferred in the separate fluid from the mud flow to the actuation chamber. The hydraulically operated valve is responsive to the energy applied to the actuation chamber for creating a change in the restriction of the mud flow to thereby initiate a pressure pulse in the mud flow.

8 Claims, 2 Drawing Figures

PILOT VALVE INITIATED MUD PULSE TELEMETRY SYSTEM

BACKGROUND OF THE INVENTION

This invention relates to mud pulsers for creating pressure pulses in the flow of mud.

Mud pulse telemetry systems are well known in the oil well drilling art. Mud pulse telemetry systems transmit information through a flowing column of drilling mud. In this process the pressure in the flowing mud column at a point downhole is periodically modulated by a fluid valve. As a result, periodic pressure pulses appear in the mud which travel uphole in the surface and are detected by a pressure transducer. Information may be conveyed by the presence or absence of pulses through use of various digital and/or analog encoding and decoding techniques.

Various types of hydraulically operated valves are used for momentarily restricting the flow of mud to thereby create pulses in the mud. For example, one type of hydraulic valve involves a poppet and orifice in which the poppet is actuated toward the orifice in order to momentarily restrict the flow of fluid. In another type of device a tubular sleeve is provided through which the mud is forced to flow. The increased pressure in a separate fluid around the exterior of the sleeve causes the sleeve to decrease in interior diameter, thereby momentarily restricting mud flow and increasing pressure, thereby creating a pressure pulse in the mud flow.

An example of the last mentioned device in U.S. Pat. No. 2,898,088 in the name of Alder. This device has upper, middle and lower fluid chambers for fluid which is separate from the mud flow. Each chamber surrounds a different sleeve. The upper and lower chambers form upstream and downstream pressure chambers, and the middle chamber forms a valve for restricting the flow of mud. An electrically operated value is provided for switching the separate fluid from the upper chamber to the chamber around the sleeve in the valve. The pressure around the sleeve in the valve restricts the flow of mud therethrough, creating a pressure pulse in the mud. The electrical valve when deactuated allows the fluid, which has been transferred from the upstream reservoir to the chamber around the sleeve of the valve, to be transferred to the downstream reservoir. A pump is provided for pumping the fluid from downstream reservoir back up to the upstream reservoir.

A serious disadvantage of the latter arrangement is that severe restrictions are placed on the design of the electrically operated valve. If it is desired to operate the flow restriction valve rapidly, then the electrically operated value must be designed with very large ports for switching the separate fluid. If the ports are made large then a large amount of electrical power is required for operating the valve. If it is desired to reduce the electrical power required to operate the electrically operated valve, then it is necessary to reduce the sizes of the orifices in the valve which in turn reduces the speed with which the flow restriction valve may be operated.

Flow restriction valves for creating pulses in flowing mud are also known which employ poppets which are operated by solenoids, clutches and other means. By way of example such a device is referenced in the Oil & Gas Journal, May 29, 1978, in an article entitled "System is Available for Measuring Hole Direction" (pp. 69-76) and in U.S. Pat. No. 2,759,143.

SUMMARY OF THE INVENTION

Briefly, an embodiment of the present invention comprises a mud pulser for mud flow in a conduit. A fluid reservoir operates when positioned in the flow of mud for imparting energy from the mud to separate fluid in the reservoir. A hydraullically operated valve is inserted in the flow of mud displaced from the fluid reservoir and includes an actuation chamber for the separate fluid. A fluid operated control valve is coupled between the fluid reservoir and the actuation chamber. An electrically controllable valve is coupled between the fluid reservoir and a control port for the control valve. The electrically controllable valve is operative in response to a first electrical signal applied thereto for providing communication in the separate fluid between the fluid reservoir and the control port to thereby allow an energy transfer in the fluid between the mud flow and the control port. The electrically controllable valve is also operative in response to a second electrical signal for blocking fluid communication between the fluid reservoir and the control port. The control valve is responsive to the energy transferred in the separate fluid to the control port for assuming a first condition wherein fluid communication between the fluid reservoir and the actuation chamber is blocked, and a second condition wherein fluid communication is provided through the control valve such that energy is transferred in the separate fluid from the mud flow to the actuation chamber. The hydraulically operated valve is responsive to the energy applied to the actuation chamber for creating a change in the restriction of the mud flow to thereby initiate a pressure pulse in the mud flow.

With such an arrangement, the energy required to drive the control valve as well as the hydraulic operated valve can be derived directly from flowing mud. As a result an electrical control valve may be employed which requires a very low level of electrical energy for operation and hence reduces the electrical power requirement. This in turn permits batteries to be used to generate the electrical power requirements instead of a mud turbine driven electrical generator.

Preferably a further reservoir for fluid is provided which is operative when positioned in the mud flow for imparting energy from the mud to the separate fluid. The fluid reservoir and the further fluid reservoir are positioned in the flow of mud on opposite sides of the hydraulic valve. The control valve is also coupled between the further fluid reservoir and the actuation chamber. The control valve is operated, while blocking fluid communication between the fluid reservoir and the actuation chamber, for providing communication in the separate fluid between the actuation chamber and the further fluid reservoir, thereby allowing fluid to be transferred therebetween.

Preferably means is provided for locating the fluid reservoir and the further fluid reservoir on opposite sides of the hydraulic valve with the fluid reservoir upstream and the further fluid reservoir downstream with respect to the hydraulic valve.

Preferably a fluid pump is provided for returning the separate fluid between the further fluid reservoir to the fluid reservoir.

Preferably the hydraulically operated valve has a poppet located for movement in the mud. A piston in the actuation chamber is coupled to the poppet. The piston separates the actuation chamber into first and second chamber portions. The second chamber portion is the one which is placed in fluid communication with the fluid reservoir by the control valve to thereby receive energy through the separate fluid from the mud low. The piston is movable in response to the energy applied in the second chamber portion for moving the poppet. The control valve is further coupled between the first and second chamber portions to allow a transfer of fluid therebetween while fluid from the fluid reservoir is blocked from the actuation chamber. This arrangement permits a more rapid return movement of the piston and poppet.

DETAILED DESCRIPTION

Figure 1:
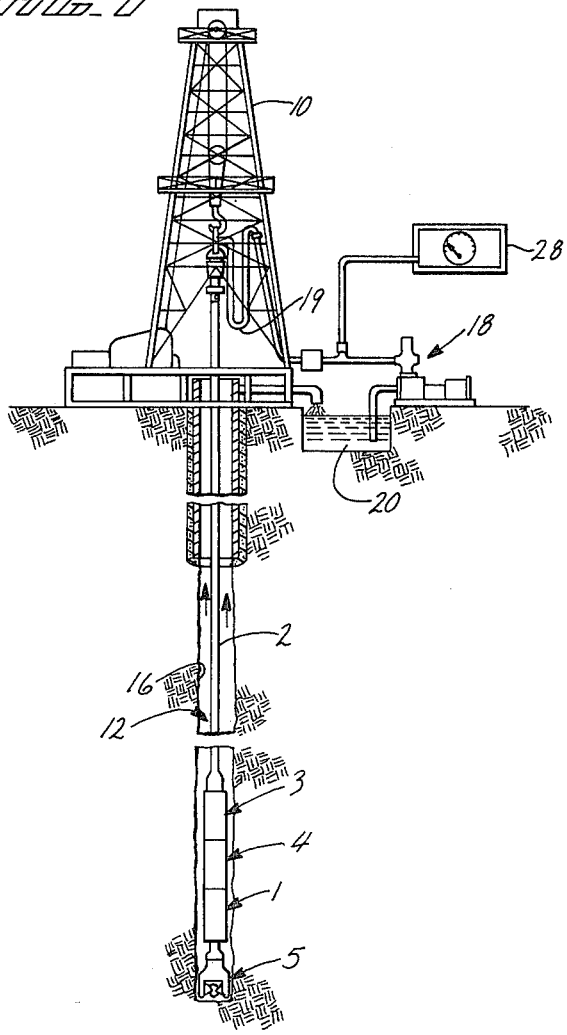
FIG. 1 is a schematic and cross-sectional view of an oil well drilling and telemetry system employing a mud pulser and embodying the present invention.

FIG. 1 depicts an oil well drilling system configured for a stationary string, downhole mud motor or turbine drill drilling operation and embodies the present invention. A mud pulse telemetry system is included and is used as part of a wireless steering rool for orienting a mud motor 1 and monitoring its drilling progress in terms of magnetic direction and borehole inclination angle. A drilling derrick 10 is connected to and supplies tension and reaction torque for a drilling string 12 which includes the mud motor 1 as well as drill pipe 2, standard drill collars 3, a non-magnetic drill collar section (hereinafter non-magnetic drill collar) 4, and a conventional drill bit 5. A conventional mud pump apparatus 18 pumps mud out of a mud pit 20, passing the mud through conduit 19 to the interior of the drill string 12. The interior of the drill string 12 is generally tubular, allowing the mud to flow down through the drill string, exiting near the drill bit 5 and recirculating back upward along the annulus, between the drill string and the wall of the borehole, where the mud returns to the mud pit 20.

The drilling system of FIG. 1 includes a steering tool (shown in FIG. 2 but not shown in FIG. 1) which is located in the interior of the non-magnetic drill collar 4, the drill collar being located in the drill string. The steering tool 22 (FIG. 2) includes a mud pulser 26 which embodies the present invention and which generates signals in the mud flowing down through the drill string 12. In addition, the steering tool 22 includes electronics for applying electrical control signals to the mud pulser to control its sequence of operation. However, the electronics do not form any part of the present invention and are not disclosed in detail herein. A transducer and indicator 28 sense and indicate the pulses in the mud received at the top of the borehole 16.

Although FIG. 1 discloses a steering tool having a mud pulser used in stationary string drilling operations, the mud pulse telemetry system described herein by way of example may also be employed in conventional rotary drilling operations. Typical applications for such a system include formation logging, directional surveying, critical downhole drilling parameters, and pending blowout protection.

Figure 2:
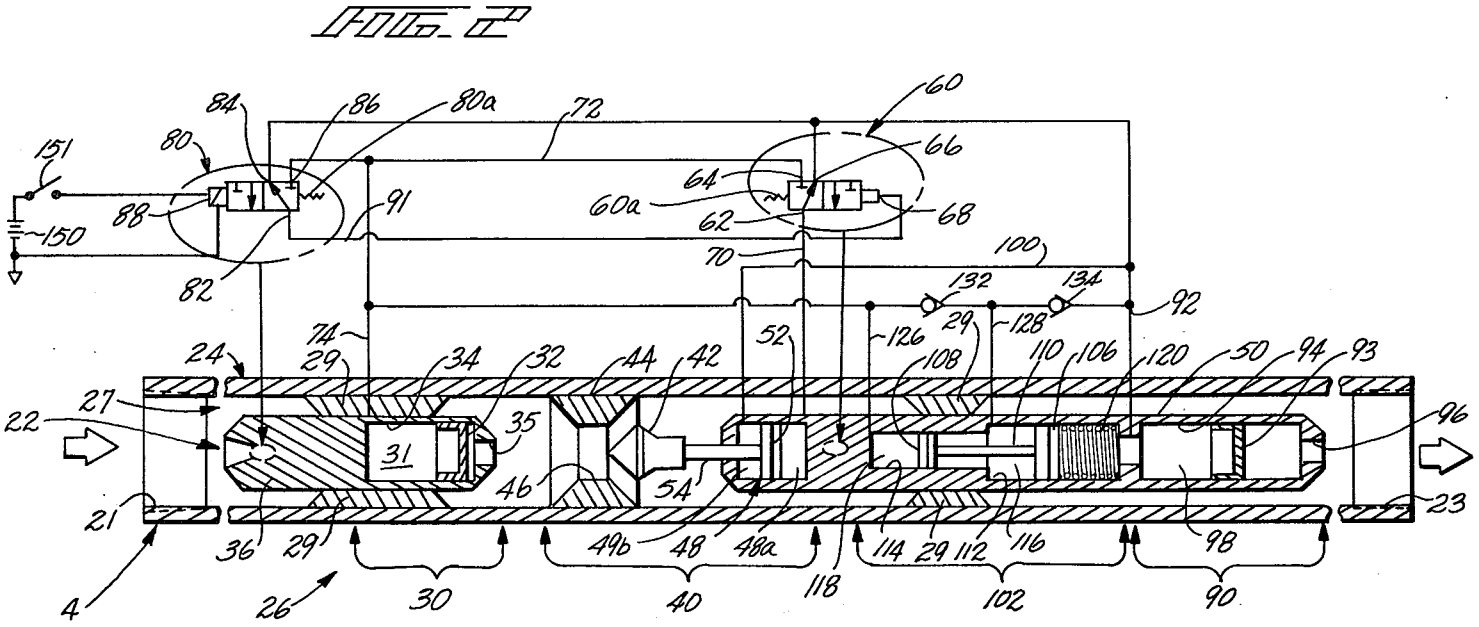
FIG. 2 is a schematic and cross-sectional view of a portion of the drill string and the mud pulser portion of the steering tool of FIG. 1.

Refer now to FIG. 2 which shows a schematic and cross-sectional view of a portion of the non-magnetic drill collar 4 and mud pulser 26 (which forms part of the steering tool 22), the latter embodying the present invention. The drill collar 4 is tubular, having an interior passage 27 for receiving mud from the rest of the drill string, and has female threaded end portions 21 and 23 for connecting, respectively, to the lower end of an upper drill string and to the upper end of a lower drill string.

The mud pulser 26 is mounted on the interior wall of the drill collar 4 by keys 29. The keys have spaces therebetween to allow free mud flow to pass by and around the mud pulser along passage 27. The mud pulser includes an upstream reservoir 30. The reservoir 30 contains a clean separate fluid 31, such as oil, which is kept separate from the mud and is operative when positioned within the flow of mud through the drill collar 4 for imparting energy from the mud to the separate fluid. To this end the reservoir 30 includes a conventional free-floating, generally cup-shaped piston 32 sliding on the wall of a hydraulic cylindrically-shaped chamber 34. The chamber 34 is formed within a generally cylindrical-shaped housing 36 and has an opening 35 through which mud is permitted to pass and act against the right hand side of movable piston 32. The separate fluid is located on the left side of piston 32 in chamber 34 thereby permitting pressure and the energy of the mud to be transmitted through piston 32 to the separate fluid.

A hydraulically operated valve 40 is positioned downstream in the flow of mud from the upstream reservoir 30. The hydraulic valve 40 includes a generally conical-shaped poppet 42 and a ring-shaped orifice 44. The poppet 42 and the orifice 44 form a valve which provides varying restrictions to the flow of mud passing through the interior passage 46 of the orifice.

The hydraulic valve 40 also includes a closed actuation chamber 48. The actuation chamber 48 is a generally cylindrical-shaped chamber, within an elongated cylindrical-shaped housing 50, and also contains the clean separate fluid 31. A cylindrical-shaped piston 52 is positioned within the chamber 48, dividing the chamber 48 into chamber portions **48*a* and 48*b*. The piston 52 in turn is connected by means of shaft 54 to the poppet 42**.

A fluid operated control valve 60 is coupled between the upstream reservoir 30 and the actuation chamber portion **48*b* of chamber 48. Control valve 60 is schematically depicted in FIG. 2 using hydraulic symbols conventionally used in the hydraulic art. Control valve 60 is a two-position, three-way, pilot pressure operated, spring return directional control valve of a type well known in the hydraulic art. The control valve has a high presure port 64, a low pressure port 66, an actuator port 62 and a control port 8. In the absence of pressure, or pressure below a predetermined level at control port 68, control valve 60 is arranged with a spring return (depicted schemtically at 60*a*) which normally caused port 62 to be connected to port 66 and disconnected or blocked from port 64. Port 62 is connected by conduit 70 to chamber portion 48*b* and port 64 is connected by means of conduits 72 and 74 to the upstream reservoir 30**.

An electrically controllable pilot valve 80 is coupled between the upstream reservoir 30 and the control port 68 of the control valve 60. The pilot valve 80 is a two-position, three-way, solenoid operated, spring return, directional control valve of the general type known in the hydraulic art. The pilot valve 80 has a high pressure port 86, a low pressure port 84, a pilot pressure output port 82 and an electrical input schematically depicted at 88. The port 82 is connected by means of conduit 91 to control port 68, control port 68 is connected by means of conduit 72 to control port 64, and port 84 is connected by means of conduit 92 to the downstream reservoir 90. The pilot valve 80 requires a very low electrical power for operation. A first signal, i.e., the absence of electrical power, allows a spring return (depicted schematically at 80*a*) in the pilot valve 80 to switch it to the condition generally depicted in FIG. 2 wherein high pressure port 82 is connected to port 84 but disconnected from port 86. Application of a low level electrical signal to pilot valve 80 causes it to switch conditions, causing port 82 to be connected to port 86 and disconnected from port 84.

As schematically depicted in FIG. 2, the pilot valve 80 is actually physically located at the left hand end of housing 36, and control valve 60 is physically located within housing 50.

A downstream reservoir 90 forms a further reservoir for the clean separate fluid 31 and is operative in response to the mud flow for imparting energy from the mud to the separate fluid therein. The downstream reservoir 90 has a free-floating piston 93 slidably mounted within a hydraulic cylinder-shaped chamber 94 of similar shape and construction to the piston 32 and chamber 34 of upstream reservoir 30. The piston 93 and chamber 94 are located within the housing 50. A passage 96 provides a passage for the mud to pass to the right hand side of piston 93. The separate fluid 31 is captured to the left of piston 93 and piston 93 transfers the pressure and therefore energy between the mud and the separate fluid. The conduit 92 is connected to the separate fluid side 98 of chamber 94.

The control valve 60 is coupled by means of ports 66 and 62 and conduits 70 and 92 to the chamber portions 48*a* and 48*b*, respectively.

With this construction of the mud pulser in mind, consider now in more detail the operation thereof.

After the mud pulser is assembled, the clean separate fluid 31 is filled in in reservoirs 30 and 90, the chamber portions 48*a* and 48*b*, and in all of the conduits 70, 72, 74, 91 and 92. The collar 4 including the mud pulser is connected in a drill spring and lowered in a bore hole and mud is passed through the drill spring including collar 4.

With mud flowing through the drill collar 4, as depicted by arrows, from left to right and in a steady state condition and with no electrical signal applied at the electrical input 88 of pilot valve 80, both pilot valve 80 and control valve 60 are in the positions indicated and the mud pulser is not forming a pulse in the flowing mud. Chamber portions 48*a* and 48*b* on opposite sides of piston 52 are connected to the downstream reservoir 90. The flowing mud causes downstream reservoir 90 to be at a downhole system reference hydrostatic pressure and the upstream reservoir 30 to be at a higher hydrostatic pressure. Since chamber portions 48*a* and 48*b* are connected together, the poppet 42 is free to move to the right under the force imparted by the flowing mud. As a result the pressure drop across the orifice 44 will reach steady state at some relatively low value of approximately 20 to 50 pounds per square inch (psi).

Assume now that an electrical signal is applied to pilot valve 80. As schematically indicated this may be done by connecting battery 150 from the housing to the input 88 by means of switch 151. The pilot valve 80 is responsive to the electrical signal for switching to its second state wherein port 82 is connected to port 86, thereby connecting fluid in upstream reservoir 30 to control port 68 via conduits 74 and 91. The interior pressure of control valve 60 is referenced by means not shown but well known in the art to the pressure in the downstream reservoir 90. Therefore the difference in pressure between that applied at port 68 from upstream reservoir 30 and the referenced pressure causes the control valve 60 to switch to its second state wherein port 62 is connected to port 64 and is disconnected from port 66. In this condition the fluid in upstream reservoir 30 is connected to the chamber portion 48*a* via conduits 70, 72 and 74, and ports 62 and 64. Conduit 100 is connected between the chamber portion 48*b* and the downstream reservoir 90 at all times and therefore chamber portion 48*b* is always at the same pressure as the downstream reservoir 90, which is at a lower pressure than that in the upstream reservoir 30. The higher upstream pressure in reservoir 30 which is now applied to chamber portion 48*a* forces the piston 52 and thus the poppet 42 to the left, partially closing the passage 46 through the orifice 44 and producing a higher pressure drop across the orifice 44. Typically, the expected increased pressure drop will be approximately 150 to 230 psi, depending on the mud flow rate. It is of course assumed that the mud flow rate is maintained fairly constant which it would be in a typical oil well drilling operation. As a result the net signal pulse pressure rise across the orifice 44 will be approximately 130 psi (150 minus 20 psi) to 180 psi (230 minus 50 psi).

Assume that the electrical signal applied at 88 is cancelled, i.e., goes to a second electrical condition which would occur when switch 151 is opened. The pilot valve 80 will then switch back to the condition indicated in FIG. 2 wherein control port 68 is connected to the downstream reservoir 90 via conduits 91 and 92, and ports 82 and 84 of the electrical pilot valve. Since the control port 68 and the internal reference pressure of control valve 60 are now both at the same level, the control valve 60 will also switch back to the condition depicted in FIG. 2 (via its own spring return) wherein ports 62 and 66 are connected together. As a result, chamber portions 48*a* and 48*b* are now connected together and both are connected via conduit 92 to the downstream reservoir 90 via conduit 92. It should also be noted that during the time that upstream reservoir 30 was connected to chamber portion 48*a*, a certain amount of separate fluid will have been transferred from upstream reservoir 30 to the chamber portion 48*a*. The amount of fluid transferred will be that required to actuate the piston 52 to the left. With control valve 60 connecting chamber portions 48*a* and 48*b* to the downstream reservoir 90, the fluid received in chamber portion 48*a* from the upstream reservoir 30 will be transferred to the downstream reservoir 90.

Thus at this point there is a quantity of fluid stored in the downstream reservoir 90 which requires transfer from the downstream reservoir 90 back up to the upstream reservoir 30. Otherwise the upstream reservoir 30 after several pulses would become completely empty of separate fluid.

Consider now the means and sequence of operation whereby the clean fluid, which was originally in upstream reservoir 30 and which was transferred to chamber portion 48*a* and subsequently to downstream reservoir 90, is moved back up to the upstream reservoir 30. A regenerative pump 102 is provided which consists of a disk-shaped large diameter piston 106 connected to a small diameter disk-shaped piston 108 by shaft 110.

Large diameter piston 106 and small diameter piston 108 are located in large and small cylindrical-shaped chambers 112 and 114 and large and small chambers 112 and 114 are interconnected. The two pistons of different diameters thus create three different chamber portions. The chamber portion below larger piston 106 is connected directly to and forms a part of chamber portion 94. An intermediate chamber portion 116 is located between pistons 108 and 106, and a chamber portion 118 is located on the left side of small piston 108. A coil compression spring 120 normally forces the pistons 106 and 108 to the left as seen in FIG. 2. Conduit 126 connects chamber portion 118 at the left of small piston 108 to conduit 74 which in turn is connected to upstream reservoir 30. Conduit 128 is connected to the chamber portion 116. Check valve 132 is connected between conduits 126 and 128 and check valve 134 is connected between conduits 128 and 92, and hence to chamber portion 94 and downstream reservoir 90.

At the same time that the clean separate fluid is filled in the rest of the pulser, clean fluid is also filled in chamber portions 118, 116 and 94 and in conduits 126 and 128.

Consider now the operation of the regenerative pump 102. Assume that an electrical signal has been applied to pilot valve 80, causing the electrical pilot valve 80 and control valve 60 to switch to their second states (opposite to that depicted in FIG. 2), thereby causing the poppet 42 to be moved to the left and thereby generate a pulse in the mud flow, all as described hereinabove. The rise in pressure of the mud flow through drill collar 4, due to the restriction at orifice 44, is reflected through the mud flow to the clean fluid in upstream reservoir 30 and hence through conduits 74 and 126 to the chamber portion 118 to the left of small piston 108. Check valves 132 and 134 are one-way check valves only permitting fluid flow from right to left and blocking fluid flow from left to right in FIG. 2. Therefore the increase in pressure in conduit 126 is applied in chamber portion 118 and forces the small piston 108 and hence the large piston 106 to move to the right.

The arrangement of the small and large pistons and chambers within regenerative pump 102 is such that movement of the small and large pistons 108 and 106 (which are rigidly attached together) to the right causes the intermediate chamber 116 to increase in volume, thereby allowing fluid pressure within intermediate chamber 116 to reduce below the pressure in chamber 94 in downstream reservoir 90. The decrease in pressure is greater than the cracking pressure for check valve 134, causing check valve 134 to open and allow fluid to flow from the downstream reservoir 90 into intermediate chamber 116.

When the electrical signal applied to electrical pilot valve 80 is removed, allowing electrical pilot valve 80 and control valve 60 to switch back to the normal conditions depicted in FIG. 2 and allowing poppet 42 to move back to the right, the pressure in upstream reservoir 30 and hence in chamber portion 118 is reduced, allowing the energy stored in compression spring 120, due to its compression, to move the large and small diameter pistons 106 and 108 to the left. The left movement of the large and small diameter pistons 106 and 108 causes the volume in intermediate chamber 116 to reduce and thus increase pressure of the clean fluid in the intermediate chamber 116. The rise in pressure of the clean fluid in intermediate chamber 116 is sufficient that check valve 134 is closed and check valve 132 is opened, thereby forcing fluid from the intermediate chamber 116 back to the upstream reservoir 30 via conduits 128 and 74. It will also be noted that the fluid necessary to drive the small diameter piston 108 to the right was merely borrowed from the upstream reservoir and the left movement of the piston 108 returns that borrowed fluid back to the upstream reservoir. Check valve 132 will always prevent fluid flow from left to right.

Upon initial startup of the mud flow through drill collar 4, the upstream and downstream reservoir pistons 32 and 93 may be positioned at any point within their strokes of travel. As electrical signals are applied to electrical pilot valve 80 (as described above), a regenerative pump 102 fills the upstream reservoir 30 completely, bringing the piston 32 completely to the bottom or right side stop of chamber 34, within a few cycles of the mud pulser. Thereafter, regenerative pump 102 will continue to supply enough separate fluid from downstream reservoir 90 to upstream reservoir 30 to just replace the small amount displaced from upstream reservoir 30 to the chamber portion **48*a* and control port 68** during each cycle of operation.

Several significant advantages will be noted from the construction and operation of the present invention as described. Initially it should be noted that, except for the low power electrical signal required to switch and hold the electrical pilot valve 80, all of the power required to switch the control valve 60 as well as to actuate the hydraulic valve 40 and move the poppet and to operate the regenerative pump is derived solely from the hydraulic power associated with the mud flow through drill collar 4. Significantly, this minimizes the amount of electrical power required to operate the system. In this regard the mud pulser is quite often located many miles below the earth's surface, creating difficulty in providing electrical power on a continuous basis. For example, if batteries are used to provide the electrical power they must be returned to the surface and replaced when the energy in the batteries has been dissipated. As a result, electrical turbines have been used for generating electrical power for mud pulses on a continuous basis downhole. However, conventional mud turbines have a number of disadvantages including limited life. By minimizing the electrical power required to generate mud pulses downhole, batteries can be used to supply the power for extended time periods without replacement. Also other very low electrical sources of power may be used.

Additionally, using an electrical pilot valve to switch a low power hydraulic pilot signal from upstream reservoir 30 to the control valve 60, which in turn switches the larger volume of clean fluid required to operate the mud pulser, an arrangement is provided which allows a more rapid sequence of operation to take place while at the same time minimizing the required electrical power for pulse generation. In this regard it is now possible to employ an electrical pilot valve which need only switch a very low volume of clean fluid. Where a low volume of clean fluid is being switched and a relatively high speed of operation is to be preserved, the internal orifices of the electrical pilot valve can be made quite small, thus reducing the necessary operating forces and hence the amount of electrical power required to operate the valve. By way of contrast, the control valve may be capable of switching quite large volumes of clean fluid and at higher speeds. The control valve 60 may employ very large ports capable of handling the larger flow of clean fluid required to operate the hydraulically operated valve 40 without increasing the electrical power required to switch the electrical pilot valve 80.

By using an electrically operated pilot valve to in turn operate the hydraulically controlled valve for switching the clean fluid, the downhole electrical power requirement for signal generation has been substantially reduced by one or two orders of magnitude over comparable prior art systems. The pilot electrical system is in effect an "information only" electrical interface between the downhole electronic control circuits and the hydraulic valve. The electrical power necessary for producing the control signal for the electrically operated pilot valve may be stored in batteries with only minor power drain. Almost the entire power requirement for the system to generate a signal in the mud is supplied by the flowing mud through the clean protective hydraulic environment of the clean fluid within the downhole system. This hydraulic power is taken from the mud through the use of the fluid chambers and the reciprocating pistons in the regenerative pump. The electrical system does not require rotating members such as turbines which are susceptible to damage from particles within the drilling mud.

Additionally it is possible for the pulser to operate with very short signal response times due to the effects of the hydraulic control valve which is connected between the upper fluid reservoir and the actuating chamber of the hydraulic valve. With this arrangement the system will produce easily detectable pulse signals throughout a wide range of drilling flow rates, mud weights, and mud viscosities. As a result the system may be interfaced with standard drilling operation equipment and practices more easily than prior art devices.

Although an exemplary embodiment of the invention has been disclosed for purposes of illustration, it will be understood that various changes, modifications and substitutions may be incorporated into such embodiment without departing from the spirit of the invention as defined by the claims appearing hereinafter.

What is claimed is:

1. A pulser for mud flowing in a conduit, comprising:

a reservoir for fluid, separate from the mud, operative when positioned in such flow of mud for imparting energy from the mud to the separate fluid therein;

hydraulically operated valve means adapted for insertion in such flow of mud displaced from the fluid reservoir and comprising an actuation chamber for fluid separate from the mud;

a fluid operated control valve coupled between the fluid reservoir and the actuation chamber and having a control port;

an electrically controllable valve coupled between the fluid reservoir and the control port, the electrically controllable valve being operative in response to a first electrical signal applied thereto for providing communication in the separate fluid between the fluid reservoir and the control port to thereby allow energy in the flow of mud to be applied through the separate fluid to the control port, the electrically controllable valve being operative in response to a second electrical signal condition for blocking the separate fluid communication between the fluid reservoir and the control port, the control valve being responsive to the energy transferred in the separate fluid to the control port when communication is established by the electrically controlled valve and the blocking of such communication for assuming a first condition wherein communication between the fluid reservoir and the actuation chamber through the separate fluid is blocked and a second condition for providing communication in the separate fluid between the fluid reservoir and the actuation chamber, the second condition thereby allowing energy in the flow of mud to be applied through the separate fluid to the actuation chamber, the hydraulically operated valve means being responsive to the energy applied to the actuation chamber for creating a change in the restriction of such flow of mud to thereby initiate a pressure pulse in the flow of mud; and a further reservoir for fluid, separate from the mud, operative when positioned in such flow of mud for imparting energy from the mud to the separate fluid therein, the fluid reservoir and the further fluid reservoir being adapted for positioning in the flow of mud on opposite sides of the hydraulically operated valve means, the control valve also being coupled between the further fluid reservoir and the actuation chamber, the control valve being operative, while blocking communication in the separate fluid between the fluid reservoir and the actuation chamber, for providing communication in the separate fluid between the actuation chamber and the further fluid reservoir to allow separate fluid to be transferred therebetween.

2. A pulser for mud according to claim 1 comprising means for locating the fluid reservoir and the further fluid reservoir on opposite sides of the hydraulically operated valve means with the fluid reservoir upstream and the further fluid reservoir downstream with respect to the hydraulically operated valve means in the flow of mud.

3. A pulser for mud according to either of claims 1 or 2 comprising a fluid pump for transferring separate fluid between the further fluid reservoir and the separate fluid reservoir.

4. A pulser for mud according to either of claims 1 or 2 wherein the hydraulically operated valve means comprises a poppet located for moving in the flow of mud, a piston in the actuation chamber coupled to the poppet, the piston being adapted for separating the actuation chamber into first and second chamber portions, the second chamber portion being the one which is placed in communication through the separate fluid with the fluid reservoir by the control valve to thereby receive energy from the flow of mud, the piston being movable in response to the energy for moving the poppet, the control valve further being coupled between the first and second chamber portions for allowing a transfer of separate fluid therebetween while communication in the separate fluid between the fluid reservoir and the actuation chamber is blocked and thereby permit a rapid return movement of the piston and poppet.

5. A pulser for mud flowing in a conduit, comprising:

a reservoir for fluid, separate from the mud, the reservoir being coupled to the flow of mud at a first location and operative for imparting energy from the mud to the separate fluid therein;

a further reservoir for fluid, separate from the mud, the further reservoir being coupled to such flow of mud at a second location along such flow of mud and operative for imparting energy from the mud to the separate fluid therein, the second location being at a position where the pressure in the flow of mud will be different from the pressure at the second position;

hydraulically operated valve means adapted for insertion in such flow of mud and comprising an actuation chamber adapted for containing fluid separate from the mud;

a fluid operated control valve coupled between the fluid reservoir and the actuation chamber and having a control port; and an electrically controllable valve coupled between the fluid reservoir and the control port, the electrically controllable valve being operative in response to a first electrical signal condition applied thereto for providing communication in the separate fluid between the fluid reservoir and the control port to thereby allow energy in the flow of mud to be applied through the separate fluid to the control port, the electrically controllable valve being operative in response to a second electrical signal condition for blocking the separate fluid communication between the fluid reservoir and the control port, the control valve being responsive to the energy transferred in the separate fluid to the control port when communication is established by the electrically controllable valve and the blocking of such communication for assuming a first condition wherein communication between the fluid reservoir and the actuation chamber through the separate fluid is blocked and for assuming a second condition for providing communication in the separate fluid between the fluid reservoir and the actuation chamber, the second condition allowing energy in the flow of mud to be applied through the separate fluid to the actuation chamber, the hydraulically operated valve means being responsive to the energy applied to the actuation chamber for creating a change in the restriction of such flow of mud to thereby initiate a pressure pulse in the flow of mud, the control valve also being coupled between the actuation chamber and the further fluid reservoir, the control valve being operative, while blocking communication in the separate fluid between the fluid reservoir and the actuation chamber, for providing communication in the separate fluid between the actuation chamber and the further fluid reservoir to allow the separate fluid to be transferred therebetween.

6. A pulser for mud according to claim 5 comprising means for coupling the fluid reservoir to the flowing mud and means for coupling the further fluid reservoir to the flowing mud on opposite sides of the hydraulically operated valve means with the fluid reservoir coupled upstream and the further fluid reservoir coupled downstram with respect to the hydraulically operated valve means in the flow of mud.

7. A pulser for mud according to either of claims 5 or 6 comprising a fluid pump for transferring the separate fluid between the further fluid reservoir and the separate fluid reservoir.

8. A pulser for mud according to either of claims 5 or 6 wherein the hydraulically operated valve means comprises a poppet located for moving in the flow of mud, a piston in the actuation chamber coupled to the poppet, the piston being adapted for separating the actuation chamber into first and second chamber portions, the second chamber portion being the one which is placed in communication through the separate fluid with the fluid reservoir by the control valve to thereby receive energy from the flow of mud, the piston being movable in response to the energy for moving the poppet, the control valve further being coupled between the first and second chamber portions for allowing a transfer of separate fluid therebetween while communication in the separate fluid between the fluid reservoir and the actuation chamber is blocked and to thereby permit a rapid return movement of the piston and poppet.

* * * * *

UNITED STATES PATENT AND TRADEMARK OFFICE

CERTIFICATE OF CORRECTION

PATENT NO. : 4,401,134

DATED : 30 August 1983

INVENTOR(S) : Patrick E. Dailey

It is certified that error appears in the above-identified patent and that said Letters Patent is hereby corrected as shown below:

Column 1, line 15, "in" (second occurrence) should be -- to --;
Column 3, line 28 "rool" should be -- tool --;
Column 4, line 52, "8" should be -- 68 -- ;
line 55, "caused" should be -- causes --;
Column 5, line 44, "spring" should be -- string --.

Signed and Sealed this

*Twenty-seventh* Day of *December 1983*

[SEAL]

*Attest:*

GERALD J. MOSSINGHOFF

*Attesting Officer* *Commissioner of Patents and Trademarks*